US005135129A

United States Patent [19]

Joly

[11] Patent Number: 5,135,129

[45] Date of Patent: Aug. 4, 1992

[54] LID LOCK

[76] Inventor: Martin Joly, 5309 - 52 Street, St. Paul, Alberta, Canada

[21] Appl. No.: 762,927

[22] Filed: Sep. 19, 1991

[51] Int. Cl.[5] ..... B65D 45/00

[52] U.S. Cl. ..... 220/315; 220/326; 220/908; 414/407; 414/414

[58] Field of Search ..... 220/263, 264, 315, 324, 220/326, 908, 909; 414/407, 414

[56] References Cited

U.S. PATENT DOCUMENTS

| | | | |
|---|---|---|---|
| 3,687,317 | 8/1972 | Gagel | 214/304 |
| 4,088,071 | 5/1978 | Cruse et al. | 100/245 |
| 4,155,584 | 5/1979 | Pracchia . | |
| 4,182,530 | 1/1980 | Hodge . | |
| 4,456,141 | 6/1984 | Pamment . | |

*Primary Examiner*—Gary E. Elkins
*Assistant Examiner*—Nova Stucker
*Attorney, Agent, or Firm*—Frank J. Dykas; Craig M. Korfanta; Ken J. Pedersen

[57] ABSTRACT

A lid locking device for an industrial waste container having a lid and a pair of sleeves capable of receiving the pick-up arms of a vehicle. The device has a plate rotatably disposed adjacent one of the sleeves such that the plate rotates on entry of a pick-up arm into the sleeve and a locking mechanism attached to the lid. A rotating bar with a swinging arm at its top end interconnects the plate and the locking mechanism. Rotation of the plate disengages the locking mechanism. A spring biases the rotating bar to the engaged position. An obstruction in the sleeve helps prevent manual levering of the plate within the sleeve.

3 Claims, 4 Drawing Sheets

LID LOCK

FIELD OF THE INVENTION

This invention relates to a lid locking device for industrial waste containers.

BACKGROUND AND SUMMARY OF THE INVENTION

Industrial waste containers are designed to be picked up by the pick-up arms of conventional front end loader garbage trucks. The pick-up arms are received by a pair of sleeves disposed on either side of the industrial waste container. As the industrial waste container is lifted over the garbage truck and consequentially rotated, the lid of the industrial waste container opens and garbage within the industrial waste container falls into the garbage truck. This system requires that as the industrial waste container is rotated to an inverted position, the lid be able to release.

At the same time, it is desirable to be able to lock industrial waste containers, both to prevent unauthorized access to the garbage, and to prevent contamination of the contents of the industrial waste container. Contamination is a particular problem where products are being re-cycled.

Automatic lid locking systems have been proposed to enable the lid of an industrial waste container to be automatically unlocked by the approach of a garbage truck. Examples are shown in U.S. Pat. No. 4,182,530 to Hodge; U.S. Pat. No. 3,687,317 to Gagel; U.S. Pat. No. 4,155,584 to Pracchia; U.S. Pat. No. 4,456,141 to Pamment; and U.S. Pat. No. 4,088,071 to Cruse et al. Hodge's mechanism is activated by the garbage truck pressing on a plate at the front of the industrial waste container. Gagel's mechanism is activated by the entry of the pick-up arms of the garbage truck into the sleeve of the industrial waste container.

However, there is not believed to exist a locking device that is activated by the entry of the pick-up arms into the sleeve of the industrial waste container and that combines with that either the feature of enabling the locking mechanism to be manually operated independently of the means that activates the locking device upon entry of the pick-up arms into the sleeves or the feature of including a device that helps prevent the manual operation of the means that activates the locking device.

The inventor has therefore provided a lid locking device for an industrial waste container, in which the industrial waste container includes a lid and a pair of sleeves capable of receiving the pick-up arms of a vehicle, that includes:

a plate rotatably disposed adjacent one of the sleeves such that the plate rotates on entry of a pick-up arm into the sleeve;

a locking mechanism attached to the lid;

actuation means responsive to the rotation of the plate to engage and disengage the locking mechanism; and biasing means to bias the actuation means to the engaged position.

In another aspect of the invention, the lid locking device also includes means to prevent manual levering of the plate. The sleeve of the lid locking device may include an outside wall and a first end, the plate being rotatable about a pivot external to the sleeve adjacent the first end. In this case, the plate extends into the sleeve to a point of contact with the outside wall of the sleeve, and the means to prevent manual levering of the plate includes a barrier extending inwardly from the outside wall between the point of contact and the first end.

The actuation means preferably includes a swinging arm, and the locking mechanism a fixed flange secured to the lid and a movable bolt, with the swinging arm including means for engaging the bolt; and the bolt being manually slidable from a first position in which the bolt may be secured to the fixed flange with the bolt engaging the swinging arm and to a second position in which the bolt is disengaged from the swinging arm.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
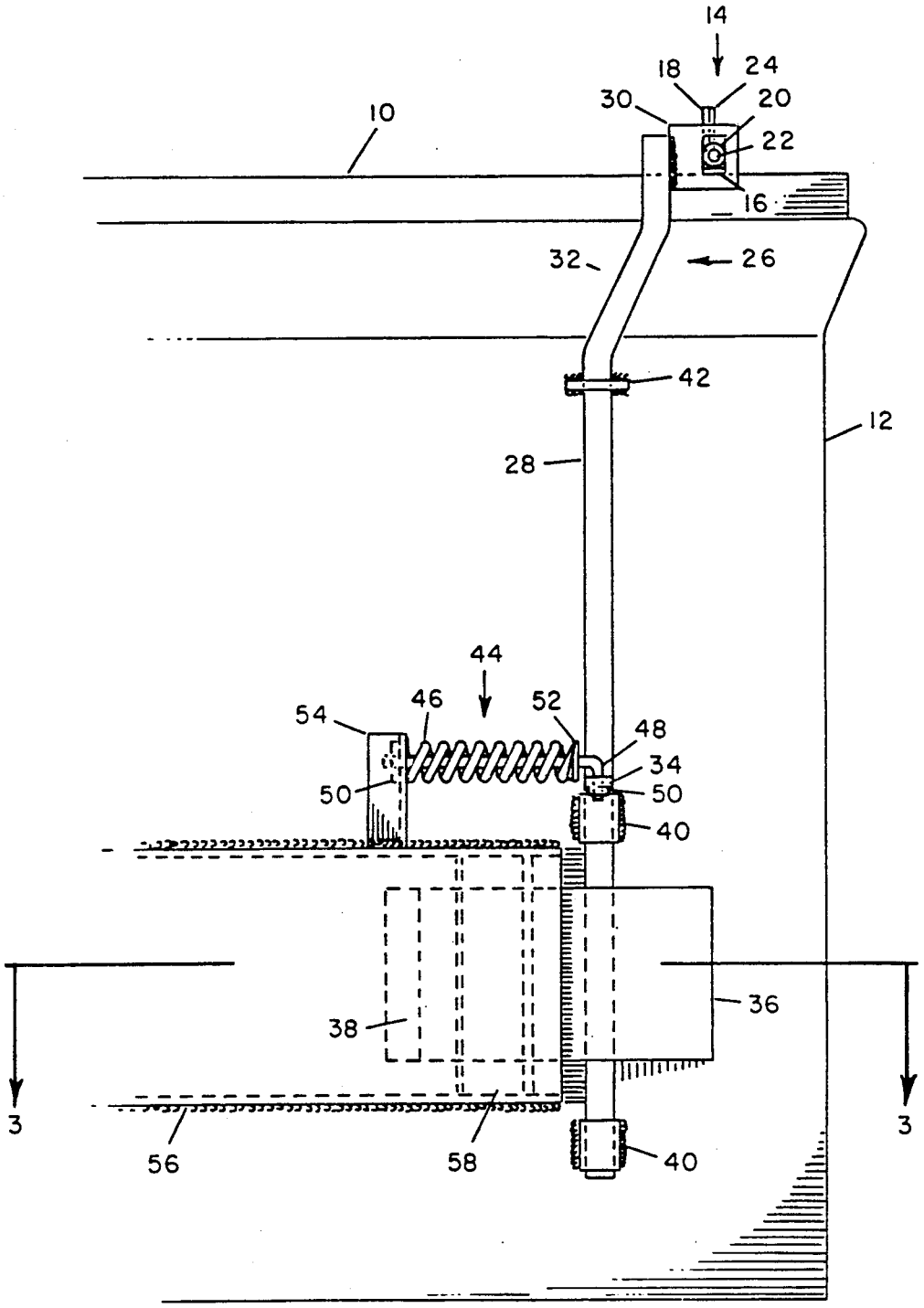
FIG. 1 is a side view of a lid locking device according to the invention.
Figure 2:
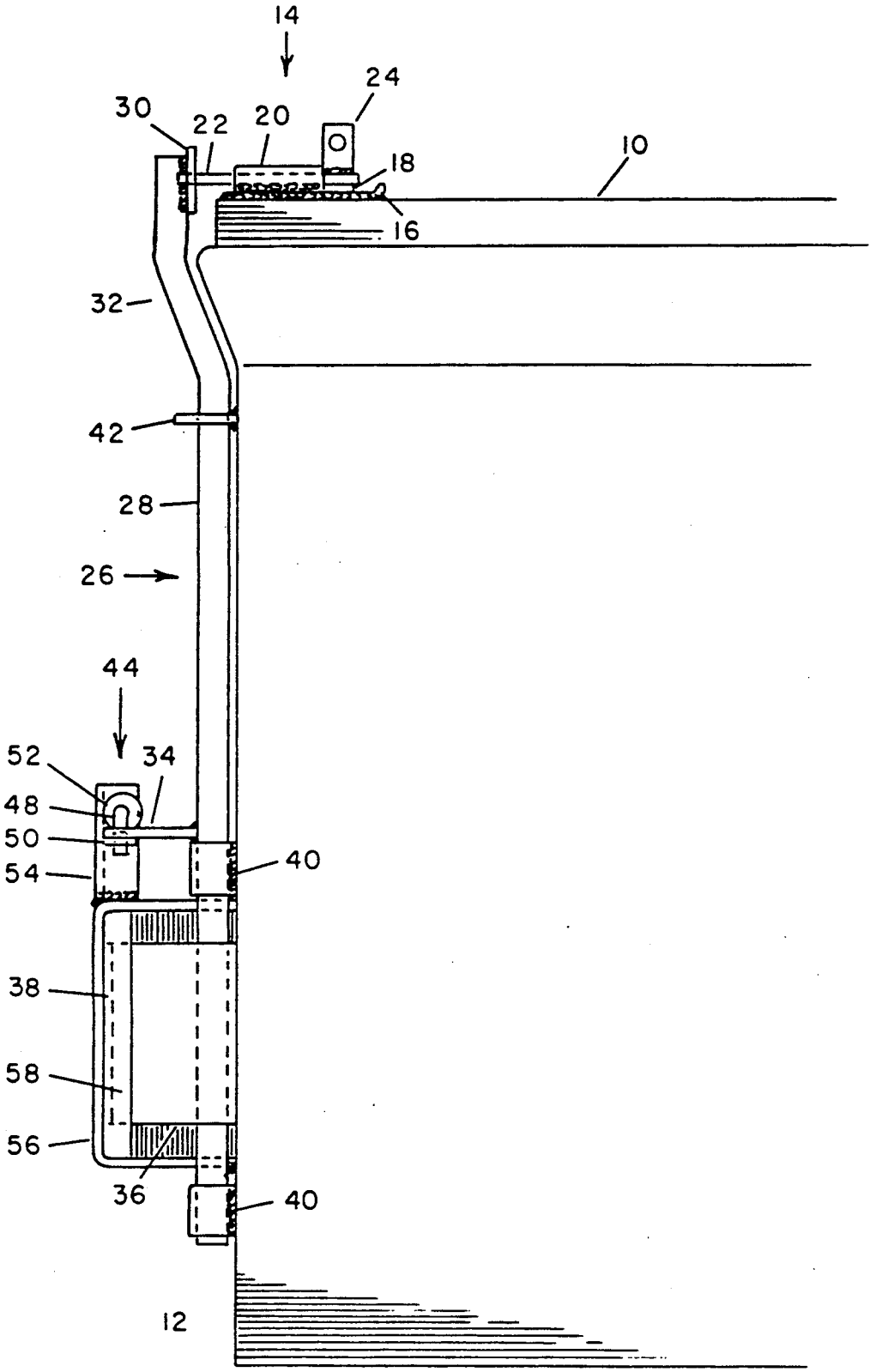
FIG. 2 is a front end view of a lid locking device according to the invention.
Figure 5:
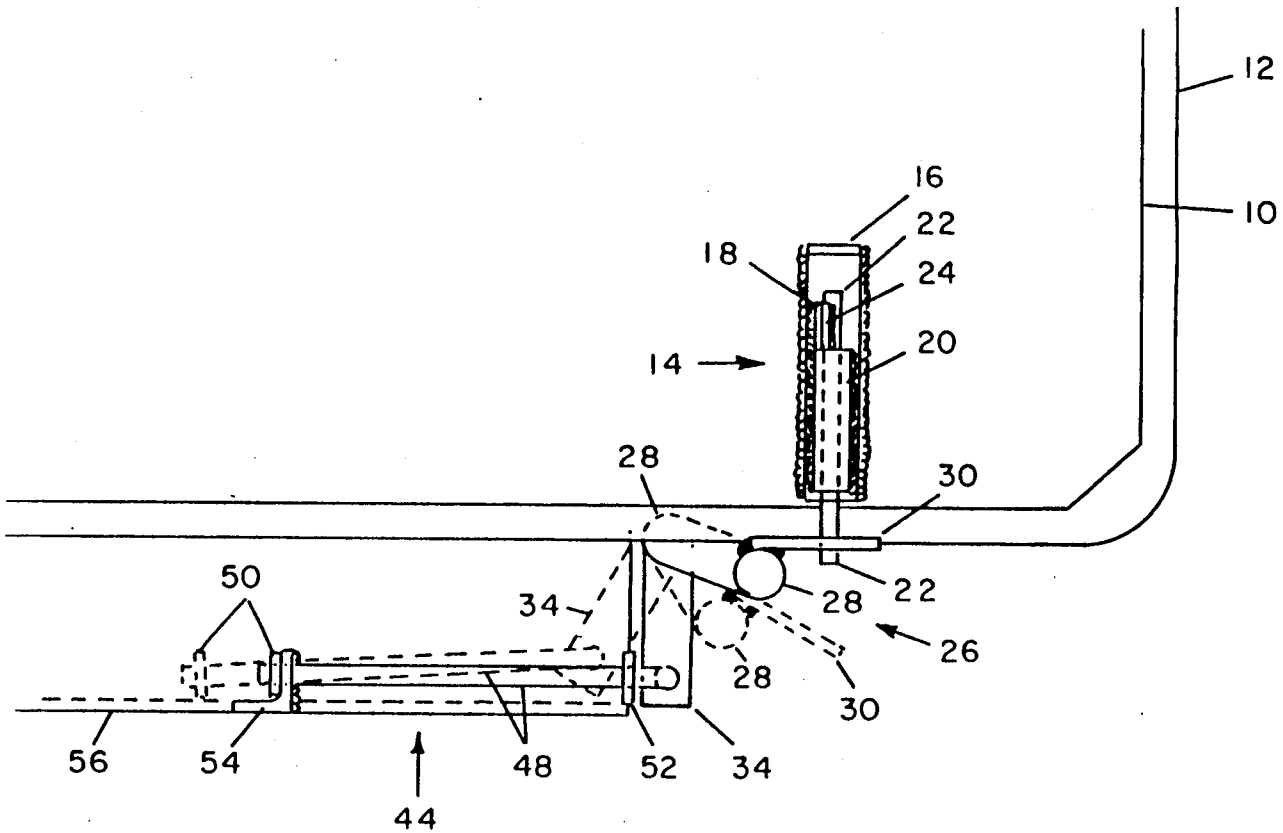
FIG. 5 is a top view of a lid locking device according to the invention.

Referring to FIGS. 1, 2 and 5, there is shown an industrial waste container 12 with a lid 10. The lid is provided with a locking mechanism 14 composed of lock plate 16 that is secured to the lid 10 for example by welding, lock flange 18 that extends perpendicularly from lock plate 16 and is welded to it, lock sleeve 20 that is also welded longitudinally along the lock plate 16, lock bolt 22 that slides within the sleeve 20 and which extends out of the sleeve at either of the ends of the sleeve 20, and bolt flange 24 that is welded to the bolt and is complementary to the lock flange 18. Both bolt flange 24 and lock flange 18 contain respective openings for receiving a standard padlock of appropriate size.

Figure 4:
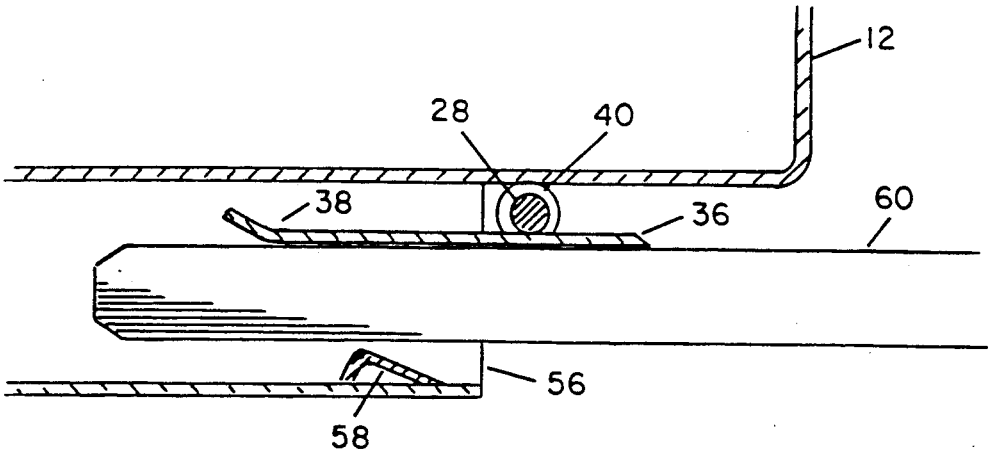
FIG. 4 shows the section of FIG. 3 in a different operating position.

Sleeve 56 is of standard construction and receives a pick-up arm 60 of a garbage truck as shown in FIG. 4. A plate 36 extends into the sleeve 56. Actuation means 26 links the plate 36 with the locking mechanism 14. The plate 36 rotates with the bar 28 acting as a pivot. The actuation means 26 is composed of a bar 28 having an angled portion at its upper end, a swinging arm or bar flange 30 extending away from the bar 28 at its upper end, and sleeves 40 together with flange 42, each welded to the side of the container 12, for rotatably receiving the bar 28. The bar flange 30 includes an opening for receiving one end of the bolt 22. Rotation of the bar 28, or equivalently, actuation of the actuation means 26, engages and disengages the bolt 22 from the bar flange 30, as the bar flange 30 moves towards and away from the bolt 22.

Biasing means 44 is fixed to the industrial waste container 12 and attached to the bar 28 by a plate 34. The biasing means 44 is composed of a spring 46 disposed about a hook bar 48. The spring should be selected so that the plate 36 is difficult to rotate without the force that may be exerted by a vehicle. This is so that the mechanism cannot be operated manually. The hook of the hook bar 48 slips into a hole in the plate 34. A stop 52 is fixed to the hook end of the hook bar 48, with the spring 46 pressing up against it. The other end of the hook bar 48 is received in an opening in an angle iron 54, with the spring 46 pressing up against the angle iron 54. A stop 50, for example a nut, is fixed on the end of the hook bar 48 to limit its range of motion, and therefore the range of motion of the bar 28 in the counterclockwise direction (as in FIG. 5). The angle iron 54 itself is welded to the sleeve 56. The force of the spring 46 between the stops 50 and 52, transmitted through the stop 52 and the hook end of the hook bar 48, acts to bias the bar 28 to the engaged position (see FIG. 5 in particular) and to resist disengagement of the swinging arm 30 from the locking mechanism 14.

The Figures are drawn to scale, and the spring 46 is preferably a 75 ft lb decompression spring, 6" long with ¼" coils. Plate 34 is preferably 2¼" long, and plate 36 10" long and 5¾" high, with the pivot 3" from the edge. The arrangement shown has been found to be suitable to prevent manual levering of the plate 36. With a 100 ft lb spring, it has been found that the pick-up arms will not enter the sleeve and with a 50 ft lb spring, it is has been found that a crow bar can be used to rotate the plate.

Figure 3:
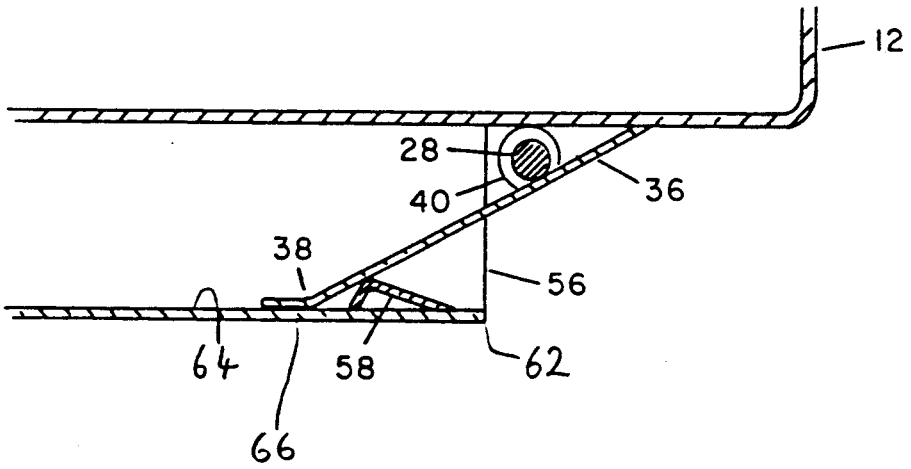
FIG. 3 is a section along the line 3—3 of FIG. 1.

Referring particularly to FIGS. 3 and 4, the sleeve 56 includes an end 62 and an outside wall 64. The plate 36 is fixed to the bar 28 for example by welding so that one end of the plate 36 extends into the sleeve 56 to a point 66 where it abuts against the outside wall 64 of the sleeve 56. The end 38 of the sleeve 56 is bent to prevent catching of the pick-up arms 60 of a vehicle (not shown) on removal of the pick-up arms 60 from the sleeve 56. Within the sleeve 56 is means to prevent manual levering of the plate 36, that includes an angled or bent plate 58 protruding into the sleeve 56 away from the outside wall 64, between the point 66 and the end 62 of the sleeve 56. The plate 58 should be angled as shown so that it does not impede entry of the pick-up arm 60 into the sleeve 56, but the closer to the pivot that it can be placed, the stronger the resistance to manual levering of the plate 36.

The operation of the lid locking device according to the invention can be most readily appreciated with reference to FIGS. 3, 4 and 5. As the pick-up arm 60 of the vehicle (not shown) enters the sleeve 56, the plate 36 is rotated from the position shown in FIG. 3 to the position shown in FIG. 4. This rotates the bar 28 to which the plate 36 is attached. Rotation of the bar 28 moves the bar flange 30 from the closed position shown in solid outline in FIG. 5 to the dashed outline also shown in FIG. 5. This disengages the locking mechanism 14 as the bar flange 30 clears the end of the bolt 22. Removal of the pick-up arm 60 from the sleeve 56 then engages the locking mechanism in the reverse manner.

The locking mechanism 14 may also be operated manually, while the bar flange 30 is engaged with the bolt 22, by sliding the bolt 22 out of the lock sleeve 20. Normally, however, the bolt flange 24 of the bolt 22 will be padlocked to the flange 18, thus preventing manual disengagement of the bolt 2 from the actuation means 26, while allowing the locking mechanism to be disengaged by the entering of the pick-up arms into the sleeve.

The means 58 prevents entry of a crow-bar into the sleeve to a point where it can use the length of the plate (from the pivot) as a lever and the outside wall 64 of the sleeve 56 as a fulcrum to shift the plate and therefore actuate the actuation mechanism.

Alternative Embodiments

A person skilled in the art could make immaterial modifications to the invention described and claimed in this patent without departing from the essence of the invention.

I claim:

1. A lid locking device for an industrial waste container, in which the industrial waste container includes a lid and a pair of sleeves capable of receiving the pick-up arms of a vehicle, comprising:

a plate rotatably disposed adjacent one of the sleeves such that the plate rotates on entry of a pick-up arm into the sleeve;

means to prevent manual levering of the plate;

a locking mechanism attached to the lid;

actuation means responsive to the rotation of the plate to engage and disengage the locking mechanism;

biasing means to bias the actuation means to the engaged position;

the actuation means includes a swinging arm; the locking mechanism includes a fixed flange secured to the lid and moveable bolt;

the swinging arm includes means for engaging the bolt; and the bolt being manually slidable from a first position in which the bolt may be secured to the fixed flange with the bolt engaging the swinging arm and to a second position in which the bolt is disengaged from the swinging arm.

2. A lid locking device for an industrial waste container, in which the industrial waste container includes a lid and a pair of sleeves capable of receiving the pick-up arms of a vehicle, comprising:

the sleeve including an outside wall and a first end wall;

a plate rotatably disposed adjacent one of the sleeves such that the plate rotates on entry of a pick-up arm into the sleeve, the plate being rotatable about a pivot external to the sleeve adjacent the first end, the plate extending into the sleeve to a point of contact to the outside wall of the sleeve;

means to prevent manual levering of the plate, including a barrier extending inwardly from the outside wall between the point of contact and the first end;

a locking mechanism attached to the lid;

actuation means responsive to the rotation of the plate to engage and disengage the locking mechanism; and biasing means to bias the actuation means to the engaged position.

3. The lid locking device of claim 2 in which:

the actuation means includes a swinging arm;

the locking mechanism includes a fixed flange secured to the lid and a movable bolt;

the swinging arm includes means for engaging the bolt; and the bolt being manually slidable from a first position in which the bolt may be secured to the fixed flange with the bolt engaging the swinging arm and to a second position in which the bolt is disengaged from the swinging arm.

* * * * *